US008196236B2

(12) United States Patent
Smythe

(10) Patent No.: US 8,196,236 B2
(45) Date of Patent: Jun. 12, 2012

(54) CONVERTIBLE FURNITURE ASSEMBLY, RELATED FRAME ASSEMBLY AND ASSOCIATED METHODS

(76) Inventor: Kevin J. Smythe, Orlando, FL (US)

( * ) Notice: Subject to any disclaimer, the term of this patent is extended or adjusted under 35 U.S.C. 154(b) by 213 days.

(21) Appl. No.: 12/422,345

(22) Filed: Apr. 13, 2009

(65) Prior Publication Data

US 2009/0205130 A1 Aug. 20, 2009

Related U.S. Application Data

(63) Continuation of application No. PCT/US2008/082633, filed on Nov. 6, 2008.

(60) Provisional application No. 60/985,730, filed on Nov. 6, 2007.

(51) Int. Cl.
*A47C 17/17* (2006.01)

(52) U.S. Cl. ..... 5/18.1; 5/37.1

(58) Field of Classification Search ..... 5/18.1, 5/37.1, 41, 47

See application file for complete search history.

(56) References Cited

U.S. PATENT DOCUMENTS 3,986,218 A 10/1976 Mizelle
4,543,675 A * 10/1985 Shrock ..... 5/37.1
4,660,235 A 4/1987 Plume
5,153,951 A * 10/1992 Hester ..... 5/37.1
6,138,299 A * 10/2000 Roma et al. ..... 5/37.1

FOREIGN PATENT DOCUMENTS

KR 2019840000941 3/1984

OTHER PUBLICATIONS

PCT International Search Report from the Korean Intellectual Property Office dated Jul. 10, 2009; pp. 1 and 2.

* cited by examiner

*Primary Examiner* — Fredrick Conley
(74) *Attorney, Agent, or Firm* — Allen, Dyer, Doppelt, Milbrath & Gilchrist, P.A.

(57) ABSTRACT

A convertible furniture assembly has a frame assembly including a base and a platform disposed over the base, the platform including a bottom platform portion slidably mounted to the base and a top platform portion pivotally connected to the platform and slidably guided by the guide plates, the platform being moveable between a seat position and a bed position. A pad assembly includes a bottom pad portion secured to the bottom platform portion and having a angled rear edge, and a top pad portion secured to the top platform portion and having an angled lower edge complementary with the angled rear edge. In the seat position, the angled lower edge of the extends over the bottom pad portion forward of the angled rear edge, and, in the bed position, the angled lower edge overlaps the angled rear edge.

13 Claims, 11 Drawing Sheets

CONVERTIBLE FURNITURE ASSEMBLY, RELATED FRAME ASSEMBLY AND ASSOCIATED METHODS

CROSS-REFERENCE TO RELATED APPLICATIONS

This application is a continuation of International Application Serial No. PCT/US08/82633, filed on Nov. 6, 2008, which claims the benefit of U.S. Provisional Application Ser. No. 60/985,730, filed on Nov. 6, 2007, the contents of which are hereby incorporated by reference in their entirety.

FIELD OF THE INVENTION

The present invention relates to devices and methods for converting a piece of furniture from one form into another, and, more particularly, to convertible furniture adapted to convert from a seat position to a bed position.

BACKGROUND OF THE INVENTION

Convertible furniture is known in the art that can serve both as sofas and chairs, and as reclining elements such as sleepers. Such furniture includes futons and sofas that have mattresses folded under the sofa's cushions that can be pulled out to form a bed.

SUMMARY OF THE INVENTION

The present invention is directed to a convertible furniture assembly, such as a sofa, that is convertible between a seat position and a bed position. According to one embodiment of the invention, a sofa includes a platform slidably engaged with a base via a pair of opposed arcuate tracks mounted on side arms of the sofa and rollers mounted on opposed sides of the platform. An actuator moved by a motor pushes and pulls the platform relative to the base to achieve a desired orientation therebetween.

According to another embodiment of the invention a convertible furniture assembly has a frame assembly including a base having substantially opposed front and rear base members extending between substantially opposed side base members, and opposed guide plates extending from the side base members, and a platform disposed over the base, the platform including a bottom platform portion slidably mounted to the base and a top platform portion pivotally connected to the platform and slidably guided by the guide plates, the platform being moveable between a seat position in which the top platform portion is arranged at an angle to the bottom platform portion and a bed position in which the bottom and top platform portions are substantially coplanar.

According to an aspect of the invention, a pad assembly includes a bottom pad portion secured to the bottom platform portion and having a angled rear edge, and a top pad portion secured to the top platform portion and having an angled lower edge complementary with the angled rear edge. In the seat position, the angled lower edge of the extends over the bottom pad portion forward of the angled rear edge, and, in the bed position, the angled lower edge overlaps the angled rear edge.

The features that characterize the invention, both as to organization and method of operation, together with further objects and advantages thereof, will be better understood from the following description used in conjunction with the accompanying drawing. It is to be expressly understood that the drawing is for the purpose of illustration and description and is not intended as a definition of the limits of the invention. These and other objects attained, and advantages offered, by the present invention will become more fully apparent as the description that now follows is read in conjunction with the accompanying drawing.

DETAILED DESCRIPTION OF PREFERRED EMBODIMENTS

Figure 1:
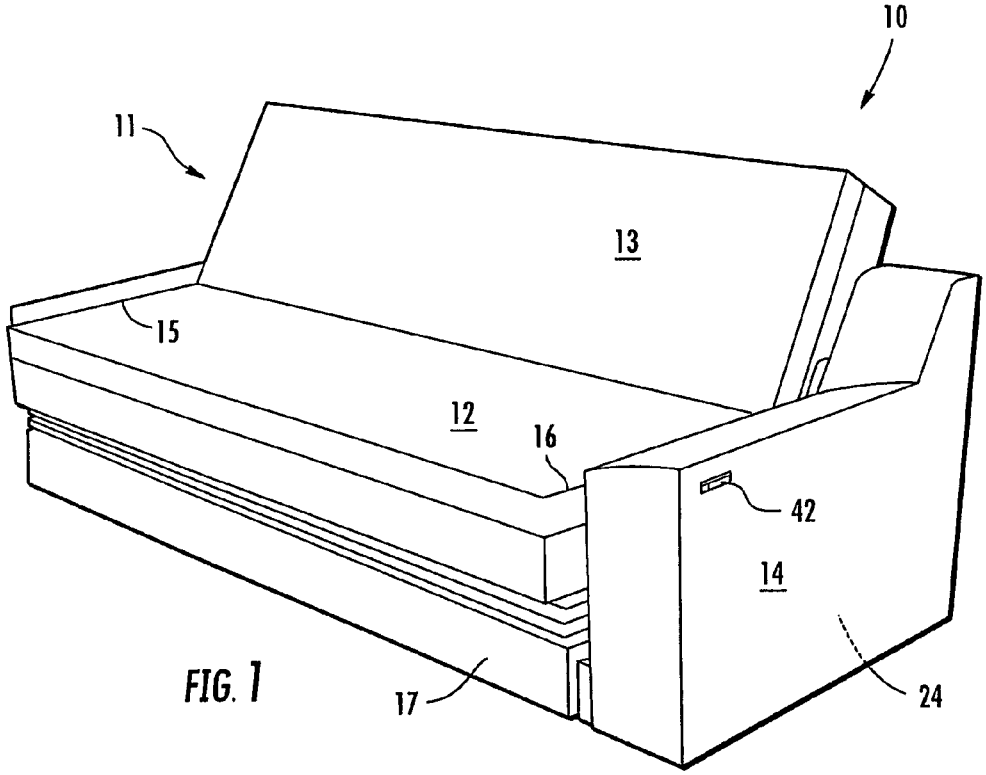
FIG. 1 is a side/front view of an exemplary sofa of the present invention.
Figure 2:
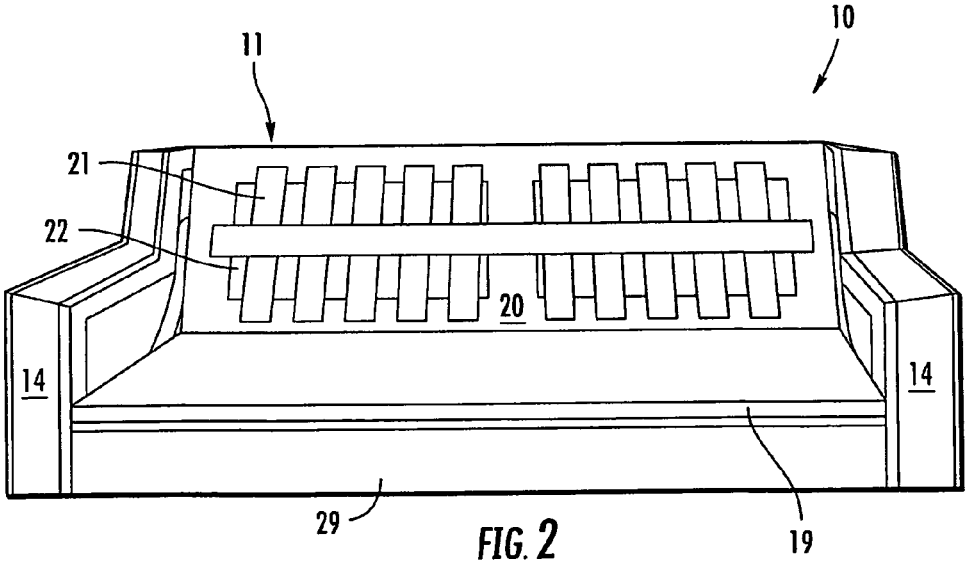
FIG. 2 is a front interior view of the sofa of FIG. 1.

According to a first embodiment of the present invention, a convertible furniture assembly, such as a sofa 10 (FIG. 1), includes an articulated platform 11 comprising a bottom 12 and top 13 portion, two opposed side arms 14 on either side 15,16 of the platform 11, and a base 17 upon which the platform 11 is supported but from which it is mechanically decoupled. The platform 11 (FIG. 2) comprises a lower foam layer 18, for example, a 3-in. foam layer, and an upper foam layer 19 thereatop, for example, a 3-in. memory foam layer. Beneath the lower foam layer 18 is a base layer 20 comprising furniture strapping 21 and two cutouts 22 for reducing weight of the platform 11.

Figure 3:
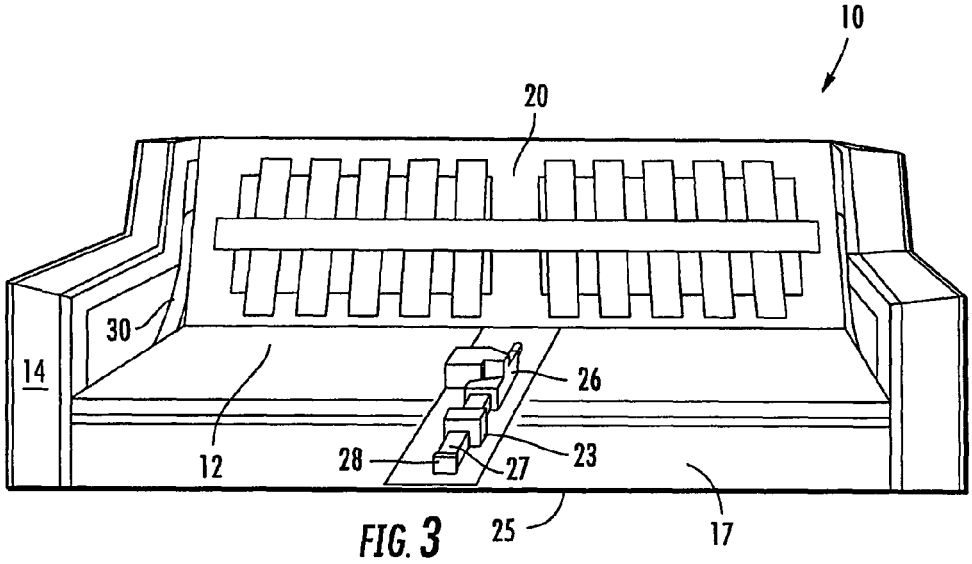
FIG. 3 is a front interior view of the sofa, illustrating the actuator device.

The base 17 (FIG. 3) comprises a mounting bracket 23 positioned substantially centrally and extends from a back edge 24 to a front edge 25 of the sofa 10. Upon the mounting bracket 23 is positioned a motor 26 connectable to a source of power. The motor 26 is positioned in motion-producing relation to an elongated actuator 27 that extends along the mounting bracket 23, and has a front end 28 that abuts the platform's front edge 29, so that a movement of the actuator 27 forces the platform 11 to move between an upright and a reclining position.

Figure 4:
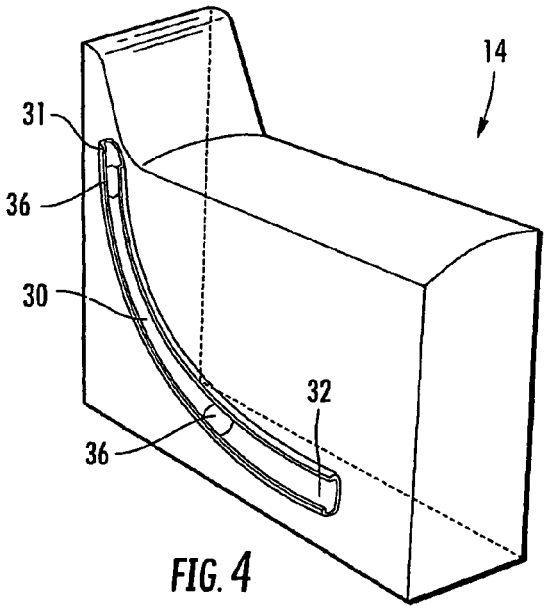
FIG. 4 is an interior view of the roller track and arm of the sofa of FIG. 1.
Figure 5:
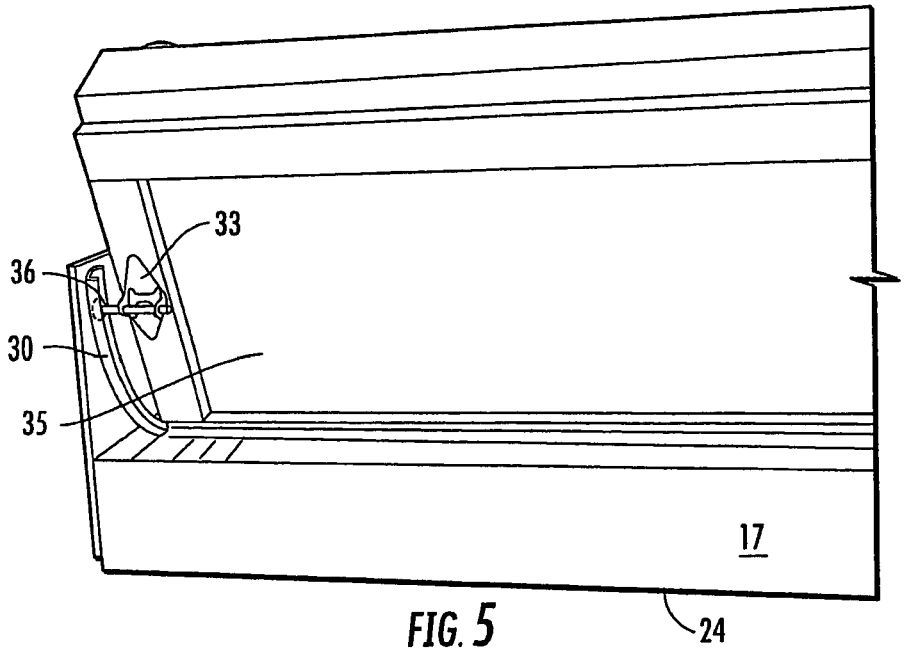
FIG. 5 is a rear view of the sofa, illustrating the track and roller mechanism.
Figure 6:
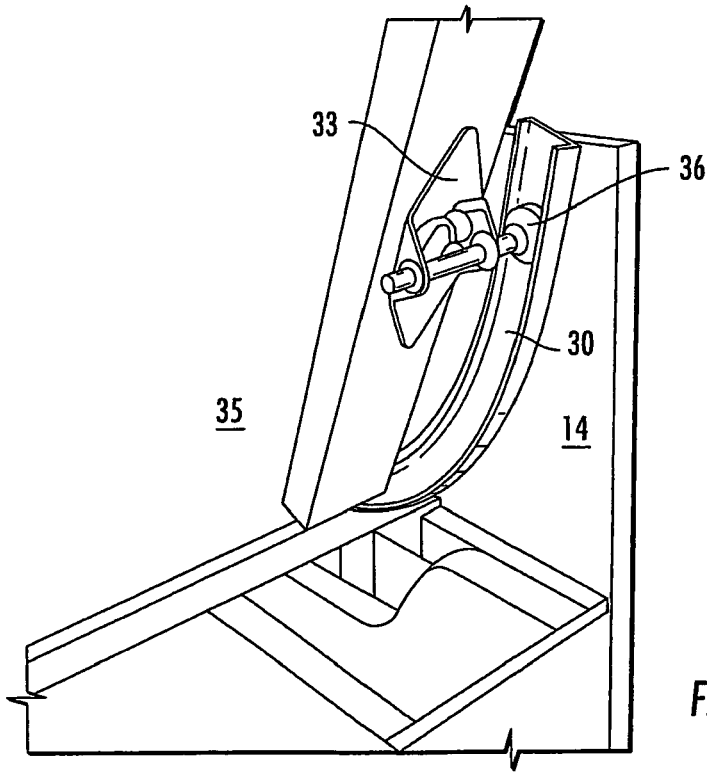
FIG. 6 is a close-up view of the track and roller mechanism.

Each of the side arms 14 (FIGS. 4-6) has affixed thereto an arcuate roller track 30 having a top end 31 and a front end 32. The platform 11 further has affixed thereto a pair of mounting brackets 33, one each on a bottom surfaces 34,35 of the bottom 12 and top 13 portions. Mounted within each of the brackets 33 is a roller 36, for example, but not intended to be limited to, 7-in. ball bearing rollers. The rollers 36 are adapted and dimensioned for rolling within the roller tracks 30 when movement is being effected by the actuator 27.

Figure 7:
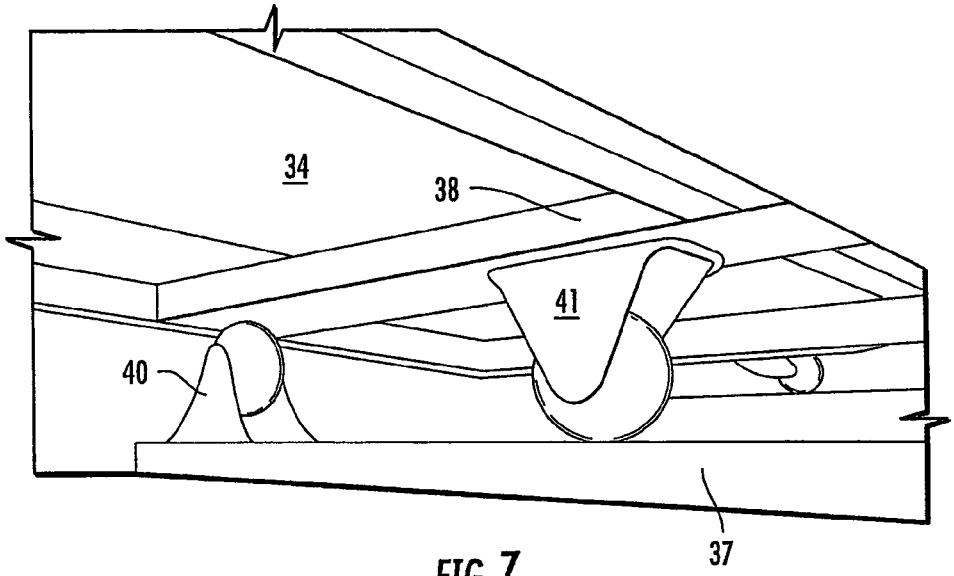
FIGS. 7 and 8 are views of the roller wheels and track.
Figure 8:
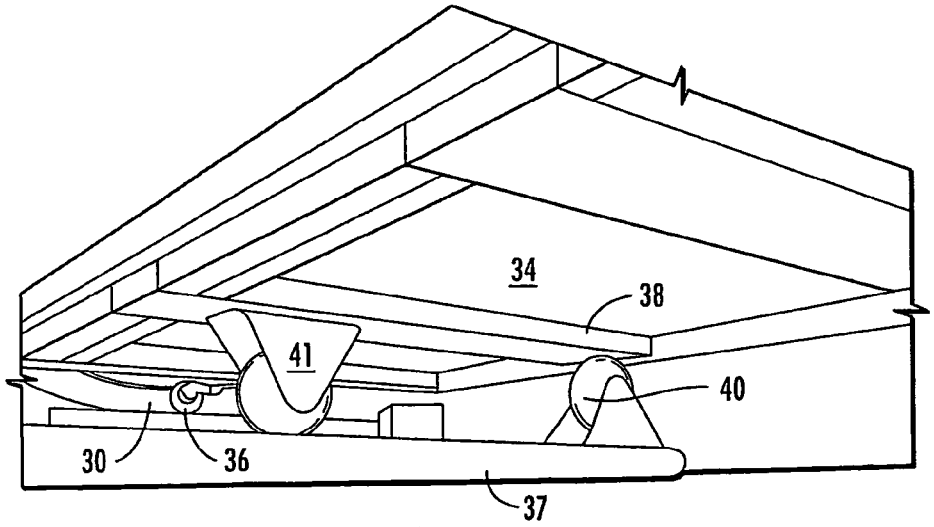

The sofa 10 additionally comprises a bottom running board 37 (FIGS. 7,8) on the base 17 and a top running board 38 on the platform's bottom face 34, each of which has affixed thereto an opposed bracket and caster wheel 40,41, respectively, and positioned to run on the opposed running board 38,37. These extra support systems function to take weight off the roller tracks 30 during movement and while stationary.

Actuation of the motor 26 is accomplished by pressing a button 42 on one or both side arms 14 (FIG. 1), which is in signal communication with the motor 26. Thus, in use, the user presses the button 42, which signals the motor 26 to cause the actuator 27 to move forward, pushing the platform 11 forward, the rollers 36 riding in the tracks 30 and the casters 40,41 running along the running boards 38,37. Pressing the button 42 while the platform 11 is in the lowered position causes the reverse to occur, and the sofa 10 is moved into the sitting position.

The sofa 10 can also be placed into an intermediate position as desired.

Figure 9:
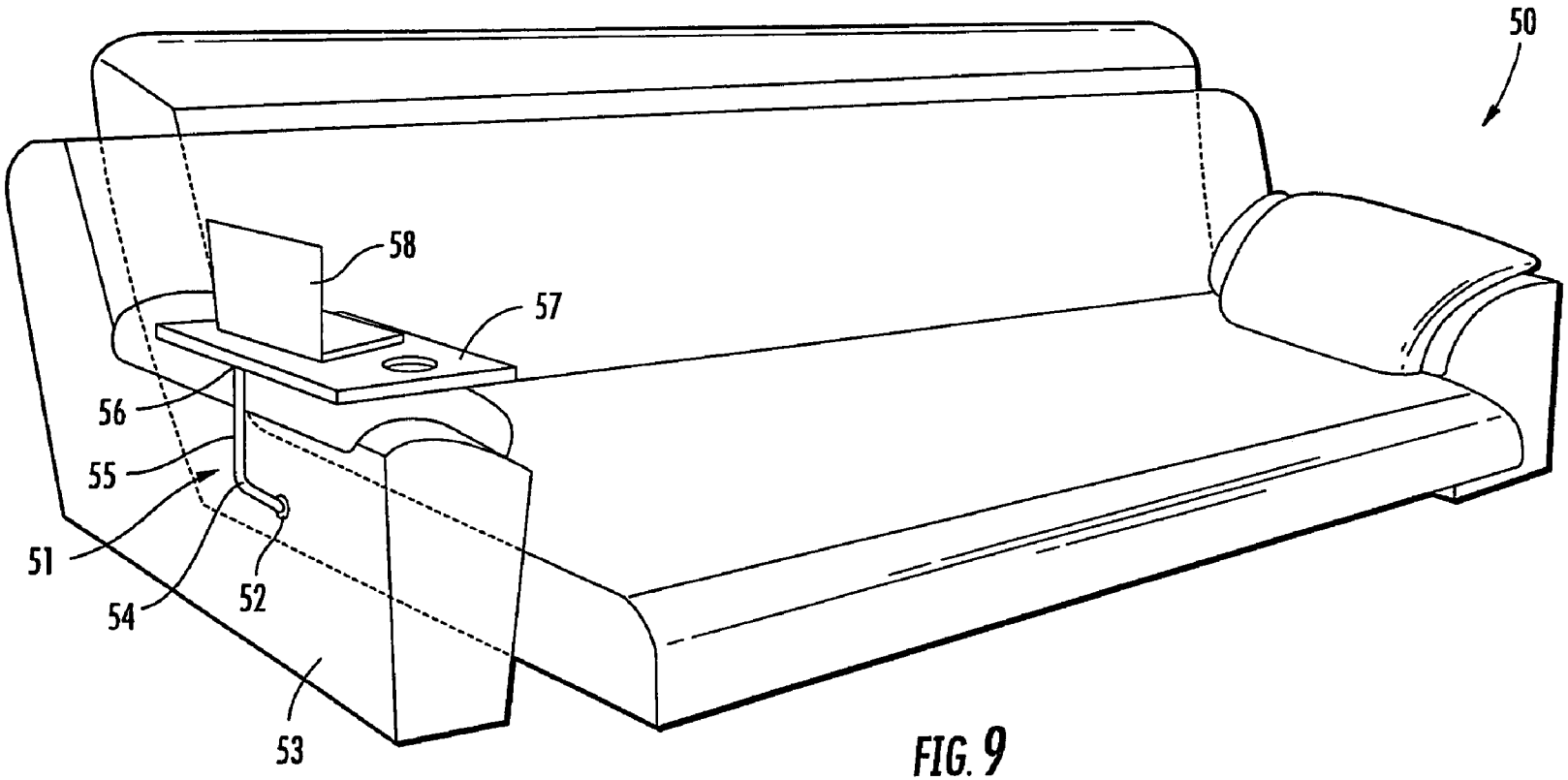
FIG. 9 is a side/front view of an embodiment of the sofa having a movable tray affixed thereto.
Figure 10:
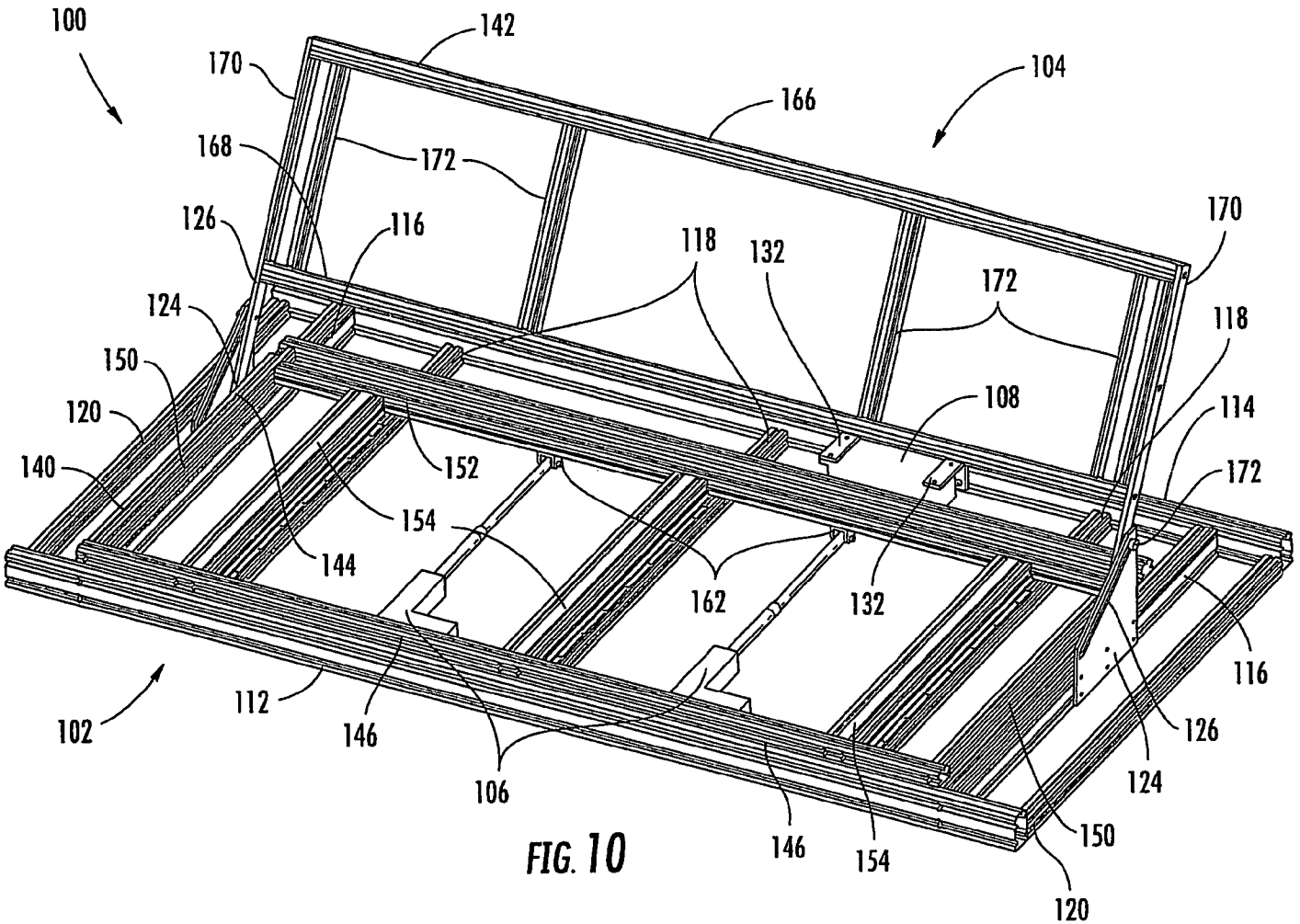
FIG. 10 is a perspective view of a convertible furniture frame assembly according to a further embodiment of the present invention, with the frame assembly in a seat position.
Figure 11:
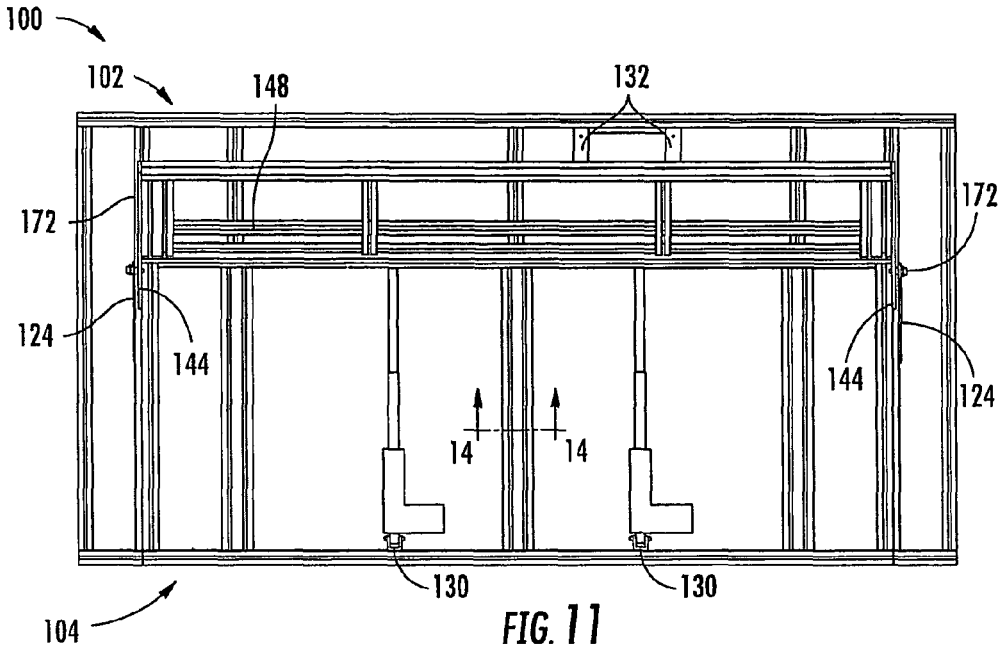
FIG. 11 is a top view of the frame assembly of FIG. 10 in the seat position.
Figure 12:
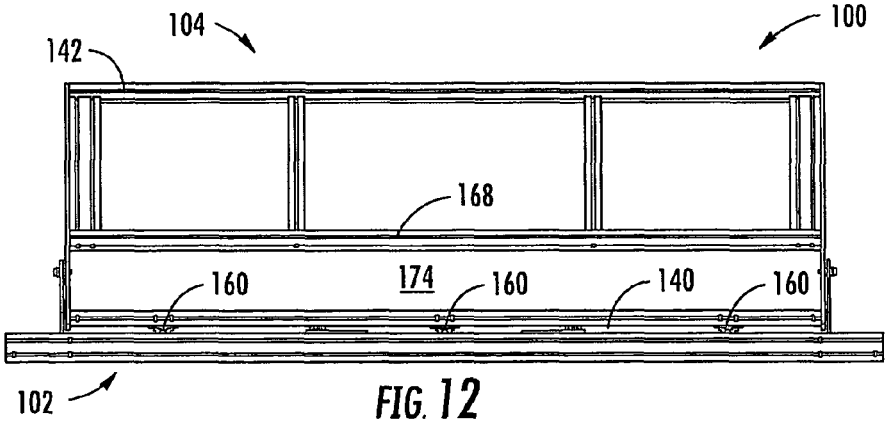
FIG. 12 is a front view of the frame assembly of FIG. 10 in the seat position.
Figure 14:
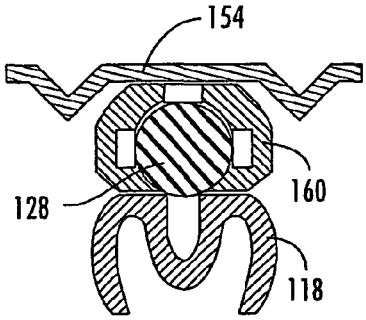
FIG. 14 is a sectional view take along line 14-14 of FIG. 11.
Figure 13:
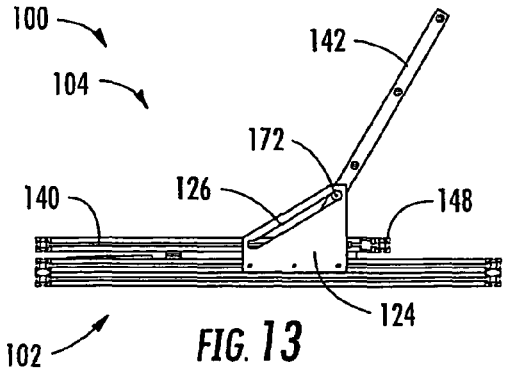
FIG. 13 is a side view of the frame assembly of FIG. 10 in the seat position.
Figure 15:
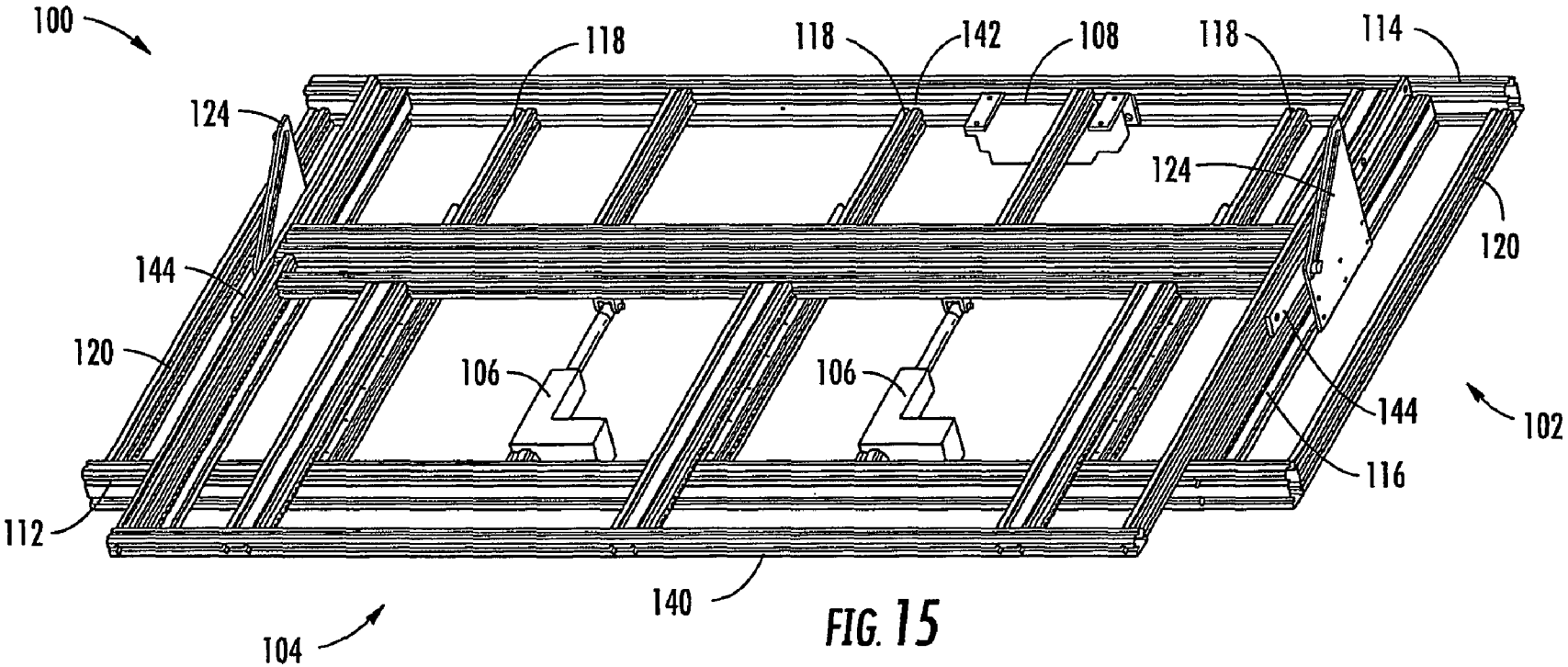
FIG. 15 is a perspective view of the frame assembly of FIG. 10 in a bed position.

In another embodiment (FIG. 9) a sofa 50 is provided that additionally comprises a movable arm 51 pivotably affixed adjacent a bottom end 52 to the sofa's side arm outer face 53. The arm 51 has a bottom section 54 that extends away from the side arm outer face 53 and a middle section 55 that extends upward. A top end 56 of the middle section 55 is affixed to a tray element 57, which can serve as an eating surface or a surface upon which a computer 58 can be positioned for use while sitting on the sofa 50.

With reference to FIGS. 10-22, a convertible furniture frame assembly 100 according to a further embodiment of the present invention will be described. The frame assembly 100 includes a base 102, a platform 104, actuators 106, and electronics 108. The platform 104 is moveable between a seat position (FIGS. 10-13) and a bed position (FIGS. 15-18). As will be appreciated from the following, the frame assembly 100 advantageously allows for greater design flexibility when determining the finished appearance of the convertible furniture, as well as simplified assembly and reduced weight.

The base 102 is formed from a plurality of frame elements, including a base front member 112 and a base rear member 114 connected by base side members 116. Additionally, a plurality of inner base cross-braces 118 extend between the front and rear members 112, 114 inwardly of the side members 116. The front and rear members 112, 114 extend beyond the side members 116 and are further connected by outer base cross-braces 120.

Platform guide plates 124 extend upwardly from the side members 116. Each guide plate 124 has a guide slot 126 defined therein. A platform guide rail 128 is connected to at least one of the inner base cross-braces. Actuator base mounting brackets 130 are connected to the front member 112 for pivotally mounting the actuators 106 thereto. Electronics mounting brackets 132 are connected to the rear member 114 for mounting the electronics 108 thereto.

The platform 104 includes a bottom platform portion 140 and a top platform portion 142 that are pivotally connected at points 144, inwardly of the guide plates 124. The bottom and top portions 140, 142 are formed from a plurality of frame elements. The bottom portion 140 includes a bottom portion front member 146 and a bottom portion rear member 148 connected by bottom portion side members 150. A bottom portion actuator mounting member 152 extends between the side members 150 forward of the rear member 148. Bottom portion cross braces 154 extends between the front member 146 and actuator mounting member 152.

Slide members 160, such as linear bearing assemblies, are connected underneath at least one of the bottom portion cross braces 154 and slidably engage the guide rail 128 connected to at least one of the inner base cross-braces 118. Actuator platform mounting brackets 162 are connected to the actuator mounting member 152 for pivotally mounting the actuators 106 thereto.

The top platform portion 142 includes top portion upper and lower members 166, 168 connected by top portion side members 170. Top portion cross braces 172 extend between the upper and lower members 166, 168. Posts 172 extend outwardly from the side members 170 through the guide slots 126 of the guide plates 124, such that posts 172 are slidably guided relative thereto. The top portion lower member 168 extends between the side members 170 above the point 144, where the bottom and top portions 140, 142 are pivotally connected, such that a gap 174 is defined between the lower member 168 and the bottom portion 140.

The actuators 106 are preferably screw driven telescoping linear actuators and act to slidably displace the platform 104 relative to the base 102. The electronics 108 include a power supply and electronic controller to power and control operation of the actuators 106.

In operation, to move the frame assembly 100 from the seat position to the bed position, the electronics 108 drive the actuators 106 to shorten, such that the bottom platform portion 140 is drawn forward relative to the base 102. The top platform portion 142 is connected to the bottom platform portion 140 at points 144 and is drawn forward with the bottom platform portion 140. While being drawn forward, the top platform portion 142 pivots rearwardly and downwardly relative to the bottom platform portion 142, the pivoting being controlled by the interaction of the posts 172 with the guide slots 126.

The dimensions of the gap 168 allow the top portion lower member 168 to narrowly clear the bottom portion rear member 148 at the end of the pivotal and translational travel of the top platform portion 142. The electronics 108 stop the actuators 106. The frame assembly 100 is then in the bed position, with the bottom and top platform portions 140, 142 cooperating to provide a substantially planar surface. To move the frame assembly 100 from the bed position back to the seat position, the above operations are performed in reverse.

Figure 19:
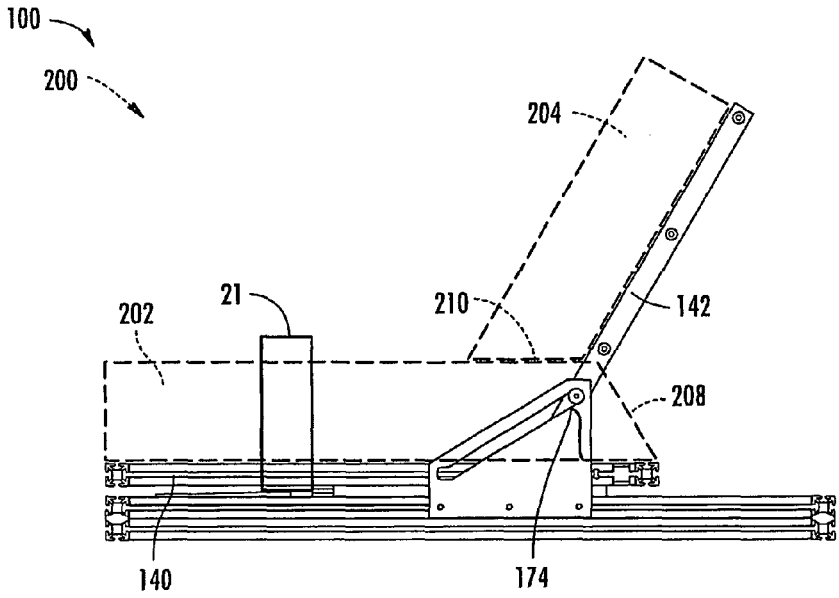
FIG. 19 is a side view of the frame assembly of FIG. 10 in the seat position, including a pad assembly.
Figure 20:
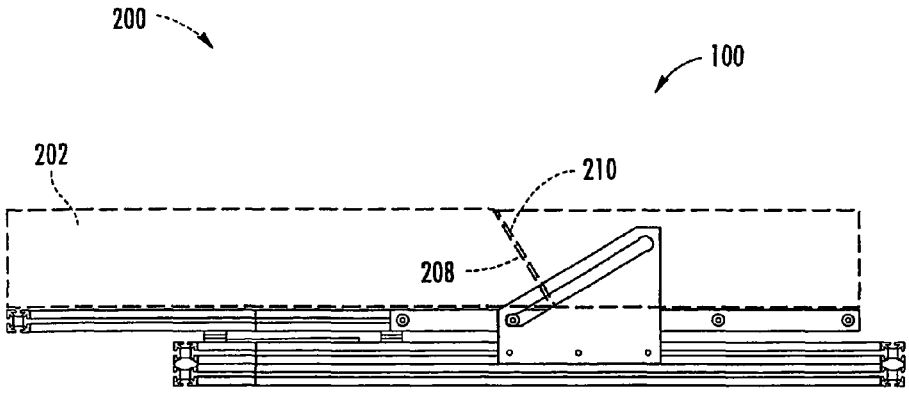
FIG. 20 is a perspective view of the frame assembly of FIG. 10 in the bed position, including the pad assembly.

Referring to FIGS. 19 and 20, a pad assembly 200 for the convertible furniture frame assembly 100 includes a bottom pad portion 202 secured to the bottom platform portion 140 and a top pad portion 204 secured to the top platform portion 142. When in the seat position, the bottom pad portion 202 extends rearwardly through the gap 174 above the bottom platform portion 140.

The bottom pad portion 202 and the top pad portion 204 have complementary angled edges 208, 210, respectively. In the seat position, the angled edge 210 prevents interference between the bottom pad portion 202 and the top pad portion 204, minimizing or eliminating compression of the pad assembly 200, which is particularly deleterious when employing memory foam or the like in the pad assembly 200. In the bed position, the angled edge 210 overlaps the angled edge 208 to create an essentially seamless joint between the bottom and top pad portions 208, 210, enhancing the comfort, feel and appearance of the pad assembly 200.

Figure 21:
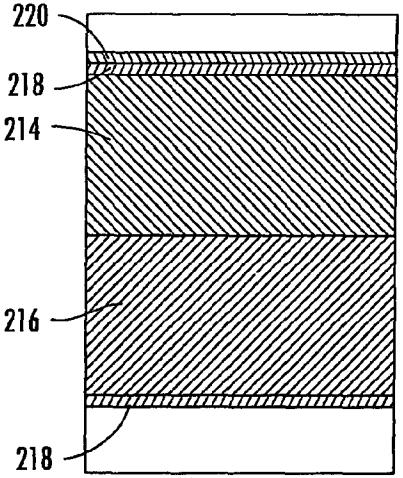
FIG. 21 is a sectional view of portion 21 of FIG. 19.
Figure 18:
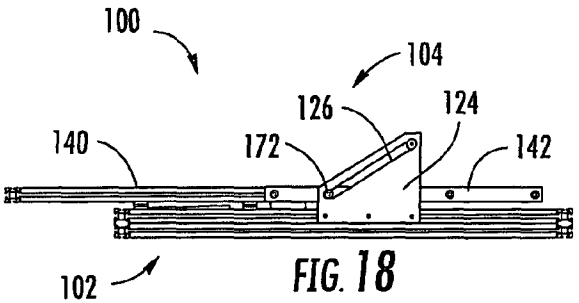
FIG. 18 is a side view of the frame assembly of FIG. 10 in the bed position.
Figure 16:
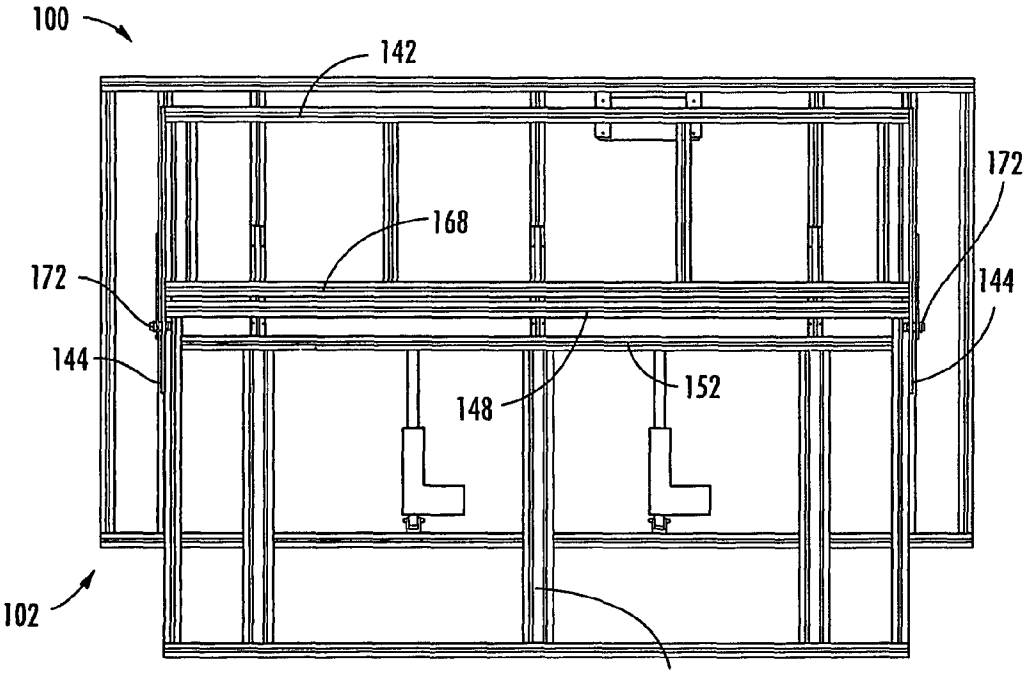
FIG. 16 is a top view of the frame assembly of FIG. 10 in the bed position.
Figure 17:
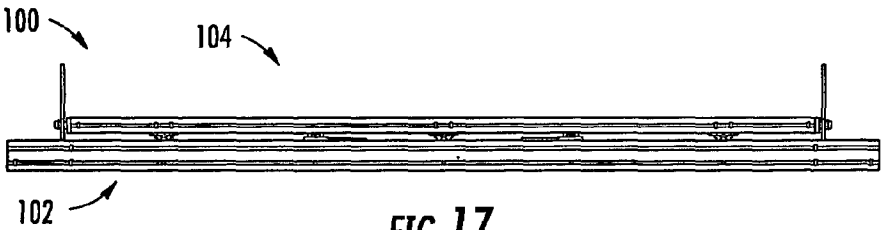
FIG. 17 is a front view of the frame assembly of FIG. 10 in the bed position.

Referring to FIG. 21, the pad 200 preferable includes a memory foam layer 214 overlaying a high density foam layer 216. A cover 218 surrounds the foam layers 214, 216, preferably formed of a synthetic fiber, such as a polyethylene terephthalate (PET) fiber. The cover 218 protects the foams and offers a lower friction surface. A suitable upholstery fabric 220 can be located over the cover, particularly on surfaces that will be visible to a user.

Figure 22:
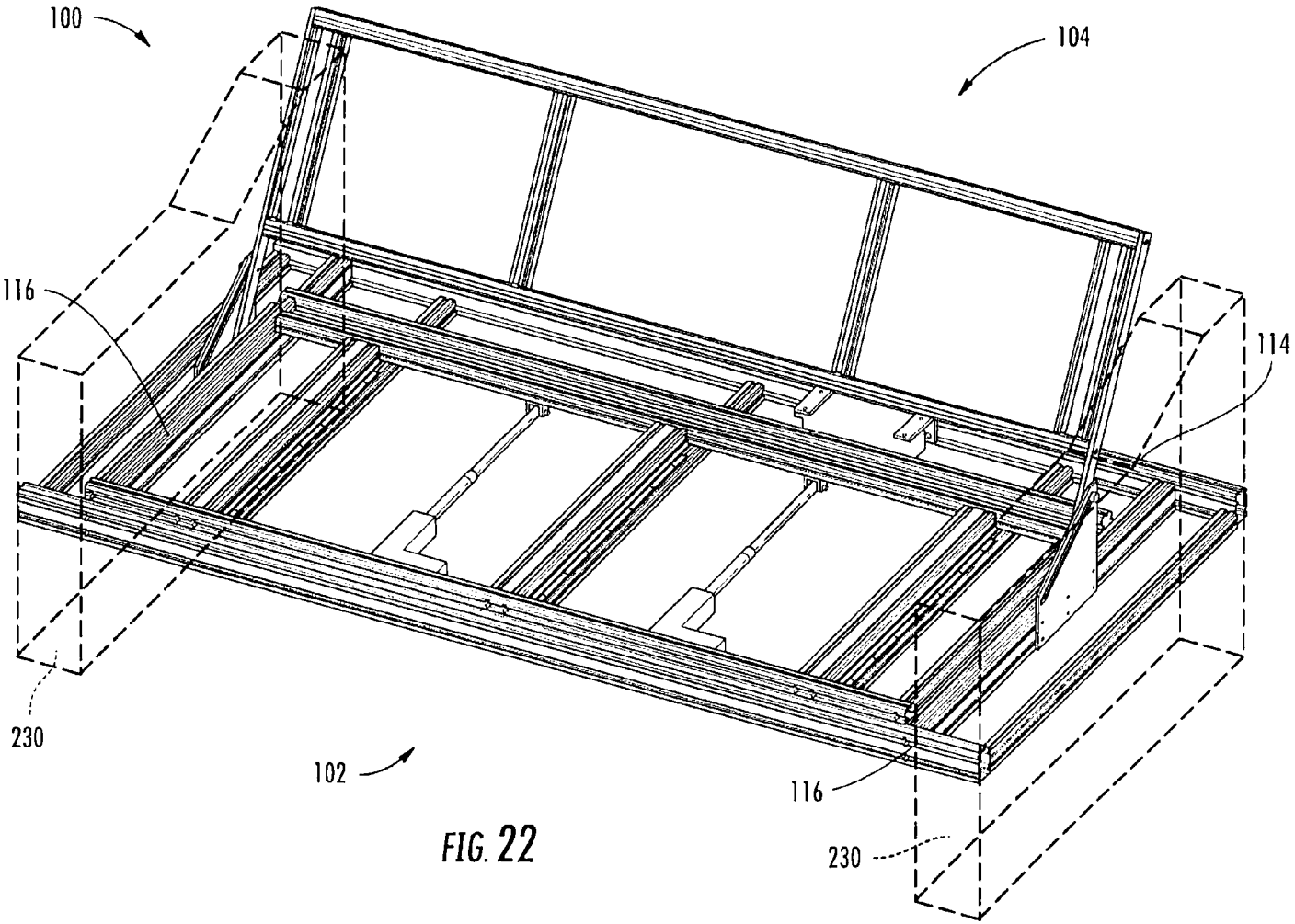
FIG. 22 is a perspective view of the frame assembly of FIG. 10 in the seat position, including arms.

Referring to FIG. 22, it will be appreciated that the frame assembly 100 can fully support transition of the platform 104 from the seated position to the bed position. The finished appearance of convertible furniture utilizing the frame assembly 100 can, as a result, be readily customized.

For example, because the frame assembly 100 does not require tracks mounted to side arms, or any rollers or other components extending significantly to the sides of the platform 104 or below the base 102, arms 230 of a wide range of designs or appearances can be quickly and easily attached to portions of the base 102 extending outward of the base side members 116. If desired, arms not extending to the floor may be employed with separate legs being attached underneath the base 102, or arms may be substantially omitted.

The above embodiments are provided for descriptive and illustrative purposes, the present invention is not necessarily limited thereto. Instead, those skilled in the art will appreciate that numerous modifications, combinations, and adaptations for particular circumstances may be made within the scope of the present invention.

For instance, the depicted embodiments depict configurations dimensioned to convert from a couch to a queen-sized bed. However, the various elements and components could be used to form other size seats, such as chairs or love seats, as well as other size beds, such as twin beds, double beds, and king beds. Additionally, features and aspects of the various embodiments can be applied to other embodiments. For instance, the tray element 57 and associated structure may readily be utilized in connection with convertible furniture featuring the frame assembly 100.

Also, the present invention is not necessarily limited to particular materials of construction. Suitable metals, such as aluminum and steel, wood, composite or synthetic materials, and combinations thereof can be used for framing and structural elements. Hinges, brackets and tracks are preferably formed from metal or other materials having suitable strength and hardness properties. Various fabrics, foams, and other padding or stuffing can be used for upholstery and padding.

Additionally, the present invention is not necessarily limited to a particular configuration or quantity of framing, cross-bracing, other reinforcement. For example, the frame assembly 100 could employ a base 102 and platform 104 having different numbers and arrangements of framing elements. For instance, the bottom portion actuator mounting member 152 could be omitted and the actuators 106 connected to other points of the platform 104. Moreover, solid sheets of material rather than discrete framing elements could be employed.

Also, the depth of the depicted base 102 is set such that the top platform portion 142 will not interfere with a wall or other vertical surface behind the base 102 during the transition between the seat and bed positions. However, the base need not necessarily prevent such interference. If prevention of interference is desired, it is also possible to have only discrete portions of the base extend to sufficient depth to prevent interference, for example, the portions outward of the base side members 116. Alternately, interference could be prevented by arms having portions extending far enough back to prevent locating the frame assembly 100 close enough to cause interference with a wall or other surface.

Furthermore, the present invention is not necessarily limited to a particular design or type of actuator, controller or power supply, or a particular number or configuration thereof. However, the use of dual actuators 106 in connection with the frame assembly 100 has been found advantageous. Likewise, the present invention is not necessarily limited to a particular number of configuration of tracks or guide rails, although the use of a single guide rail on a centrally-located cross-brace 118 of the base 102 has been found advantageous in connection with the frame assembly 100.

The foregoing is not intended to be an exhaustive list of variations. Rather, those skilled in the art will appreciate that these and other modification, combinations, and adaptations are possible within the scope of the invention herein shown and described.

What is claimed is:

1. A convertible furniture assembly comprising:
a frame assembly including:
a base having substantially opposed front and rear base members extending between substantially opposed side base members, and opposed guide plates extending from the side base members; and
a platform disposed over the base, the platform including a bottom platform portion slidably mounted to the base and a top platform portion pivotally connected to the platform and slidably guided by the guide plates, the platform being moveable between a seat position in which the top platform portion is arranged at an angle to the bottom platform portion and a bed position in which the bottom and top platform portions are substantially coplanar; and
a pad assembly including:
a bottom pad portion secured to the bottom platform portion and having a angled rear edge; and
a top pad portion secured to the top platform portion and having an angled lower edge complementary with the angled rear edge;
wherein, in the seat position, the angled lower edge of the extends over the bottom pad portion forward of the angled rear edge, and, in the bed position, the angled lower edge overlaps the angled rear edge; and
wherein the bottom platform portion remains substantially horizontal throughout movement between the seat position and the bed position.

2. The convertible furniture assembly of claim 1, further comprising:
at least one actuator extending between the bottom platform portion and the base for moving the platform between the seat and bed positions.

3. The convertible furniture assembly of claim 1, wherein portions of the base extend outward of the guide plates and are adapted to attach arms thereto.

4. The convertible furniture assembly of claim 3, further comprising:
arms connected to the portions of the base extending outward of the guide plates.

5. The convertible furniture assembly of claim 1, wherein at least one portion of the base extends sufficiently rearward of the platform to prevent interference between a wall behind the base and the top platform portion when moving the platform between the seat and bed positions.

6. The convertible furniture assembly of claim 1, wherein the base includes at least one guide rail to which the bottom platform portion is slidably mounted.

7. The convertible furniture assembly of claim 1, wherein the bottom platform portion includes bottom portion side members and a bottom portion rear member extending therebetween, and the top platform portion includes top portion side members and a top portion lower member extending therebetween, the top portion lower member being spaced apart from pivotal connection points between the top and bottom portion side members such that, in the seat position, a gap is defined between the top portion lower member and the bottom platform portion.

8. The convertible furniture assembly of claim 7, wherein the bottom portion rear member is spaced apart from the pivotal connection points between the top and bottom portion side members such that, in the bed position, the bottom portion rear member and the top portion lower member are adjacent.

9. The convertible furniture assembly of claim 7, wherein, in the seat position, the bottom pad portion extends through the gap.

10. The convertible furniture assembly of claim 1, wherein the bottom and top pad portions each include a high density foam layer and a memory foam layer.

11. The convertible furniture assembly of claim 10, wherein the high density foam and memory foam layers are each approximately three inches thick.

12. A convertible furniture assembly comprising:

a frame assembly including:

a base having substantially opposed front and rear base members extending between substantially opposed side base members, and opposed guide plates extending from the side base members; and a platform disposed over the base, the platform including a bottom platform portion slidably mounted to the base and a top platform portion pivotally connected to the platform and slidably guided by the guide plates, the platform being moveable between a seat position in which the top platform portion is arranged at an angle to the bottom platform portion and a bed position in which the bottom and top platform portions are substantially coplanar; and a pad assembly including:

a bottom pad portion secured to the bottom platform portion and having a angled rear edge; and a top pad portion secured to the top platform portion and having an angled lower edge complementary with the angled rear edge;

wherein, in the seat position, the angled lower edge of the extends over the bottom pad portion forward of the angled rear edge, and, in the bed position, the angled lower edge overlaps the angled rear edge; and wherein, in the seat position, the angled lower edge is flush with the bottom pad portion forward of the angled rear edge, and, in the bed position, the angled lower edge is flush with the angled rear edge.

13. A frame assembly for a convertible furniture assembly comprising:

a base having substantially opposed front and rear base members extending between substantially opposed side base members, and opposed guide plates extending from the side base members; and a platform disposed over the base, the platform including a bottom platform portion slidably mounted to the base and a top platform portion pivotally connected to the platform and slidably guided by the guide plates, the platform being moveable between a seat position in which the top platform portion is arranged at an angle to the bottom platform portion and a bed position in which the bottom and top platform portions are substantially coplanar;

wherein the bottom platform portion is slidably mounted to the base by at least guide rail and slide member mounted under the bottom platform portion; and wherein the bottom platform portion remains substantially horizontal throughout movement between the seat position and the bed position.

* * * * *